US009061325B2

(12) United States Patent
West et al.

(10) Patent No.: US 9,061,325 B2
(45) Date of Patent: Jun. 23, 2015

(54) AUTOMATIC PORTABLE FLUID DISPERSAL DEVICE

(76) Inventors: Scott Allen West, Mesa, AZ (US); Jason Gust West, Mesa, AZ (US)

( * ) Notice: Subject to any disclaimer, the term of this patent is extended or adjusted under 35 U.S.C. 154(b) by 399 days.

(21) Appl. No.: 13/299,023

(22) Filed: Nov. 17, 2011

(65) Prior Publication Data

US 2012/0118328 A1 May 17, 2012

Related U.S. Application Data

(60) Provisional application No. 61/414,526, filed on Nov. 17, 2010.

(51) Int. Cl.

| | |
|---|---|
| ***B08B 9/032*** | (2006.01) |
| ***B08B 3/02*** | (2006.01) |
| ***B05B 7/24*** | (2006.01) |
| ***B05B 9/08*** | (2006.01) |
| ***F04B 17/06*** | (2006.01) |
| ***F04B 23/02*** | (2006.01) |
| *B05B 1/20* | (2006.01) |

(52) U.S. Cl.

CPC ..... *B08B 9/0326* (2013.01); *B05B 7/2494* (2013.01); *B05B 1/20* (2013.01); *B05B 7/2472* (2013.01); *B05B 7/2475* (2013.01); *B05B 7/2489* (2013.01); *B05B 9/0811* (2013.01); *B05B 9/0816* (2013.01); *B08B 3/026* (2013.01); *B08B 9/0327* (2013.01); *B08B 9/0328* (2013.01); *F04B 17/06* (2013.01); *F04B 23/02* (2013.01)

(58) Field of Classification Search

None

See application file for complete search history.

(56) References Cited

U.S. PATENT DOCUMENTS

| | | | | |
|---|---|---|---|---|
| 384,630 | A | | 6/1888 | Koechlin |
| 2,705,171 | A | | 3/1955 | Ziherl |
| 3,142,443 | A | | 7/1964 | Morgan |
| 3,727,841 | A | | 4/1973 | Hengesbach |
| 4,298,166 | A | | 11/1981 | White et al. |
| 4,702,416 | A | | 10/1987 | Pagliai et al. |
| 4,899,940 | A | | 2/1990 | Leaver |
| 5,121,882 | A | | 6/1992 | Skidmore |
| 5,273,214 | A | | 12/1993 | Huffstutler |
| 5,330,104 | A | | 7/1994 | Marcus |
| 5,335,853 | A | | 8/1994 | Wirz |
| 5,409,167 | A | | 4/1995 | Borod |
| 5,535,951 | A | | 7/1996 | Utter |
| 5,746,252 | A | * | 5/1998 | Henson ..... 137/625.47 |

(Continued)

OTHER PUBLICATIONS

USPTO; Office Action dated Aug. 26, 1999 in U.S. Appl. No. 09/160,070.

USPTO; Final Office Action dated Feb. 3, 2000 in U.S. Appl. No. 09/160,070.

(Continued)

*Primary Examiner* — Nicole Blan

(74) *Attorney, Agent, or Firm* — Snell & Wilmer L.L.P.

(57) ABSTRACT

The present disclosure includes an automatic portable misting apparatus for the dispersal of fluids. The misting apparatus is customizable to a specified use and is highly portable. The misting apparatus includes a pressurizable fluid tank, an automatic air compressor mounted to the fluid tank, a fluid conduit and a hose or wand coupled to a plurality of nozzles. Fluid may be distributed in the form of a corresponding number of fine spray streams, and a valve for controlling the flow of fluid from the fluid tank to the fluid conduit. The fluids dispersal apparatus is easy to operate, easy to maintain, unobtrusive and economical.

19 Claims, 7 Drawing Sheets

(56) References Cited

U.S. PATENT DOCUMENTS

| | | | | |
|---|---|---|---|---|
| 5,775,590 | A | 7/1998 | Utter | |
| 5,931,207 | A * | 8/1999 | Gianino | 141/382 |
| 6,189,805 | B1 * | 2/2001 | West et al. | 239/74 |
| 7,115,832 | B1 * | 10/2006 | Blankenship et al. | 219/121.48 |
| 2003/0116646 | A1 * | 6/2003 | You | 239/373 |
| 2003/0192963 | A1 * | 10/2003 | Ebberts | 239/413 |
| 2009/0152382 | A1 * | 6/2009 | Charpie | 239/526 |

OTHER PUBLICATIONS

USPTO; Advisory Action dated Jun. 7, 2000 in U.S. Appl. No. 09/160,070.

USPTO; Notice of Allowance dated Aug. 21, 2000 in U.S. Appl. No. 09/160,070.

* cited by examiner

FIG. 1
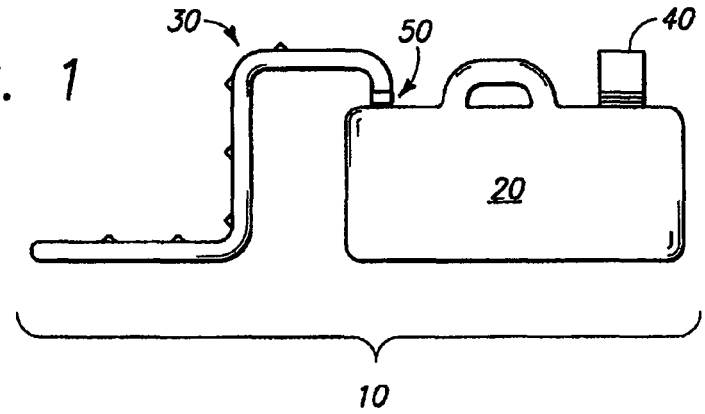
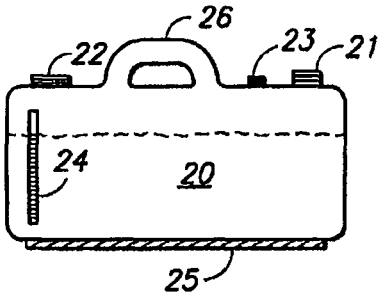
FIG. 2
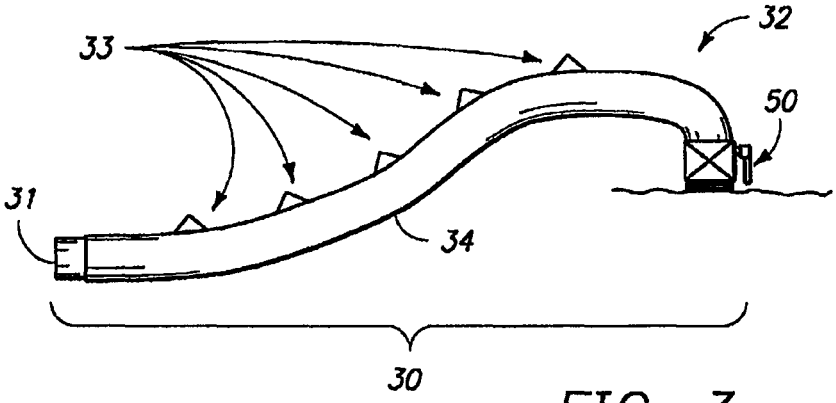
FIG. 3

AUTOMATIC PORTABLE FLUID DISPERSAL DEVICE

RELATED APPLICATION

This application claims priority to and the benefit of U.S. Provisional Application Ser. No. 61/414,526, entitled "AUTOMATIC PORTABLE FLUID DISPERSAL DEVICE" filed Nov. 17, 2010, which is incorporated herein by reference.

FIELD OF INVENTION

This disclosure generally relates to fluid dispersal devices, and more particularly, to an automatic, portable and compact fluid dispersal device for delivering a fine spray or mist of fluid to a specified area.

BACKGROUND OF THE INVENTION

There is a need for a fluid dispersal and/or misting apparatus for indoor or outdoor environments that is portable, easy to use, easy to store, unobtrusive, and effective for distributing fluid to a localized area. Accordingly, it is desirable that the misting apparatus be portable for ready transportation to a variety of outdoor locations (e.g., a yard, a beach, a boat, a campground or the like) and be adaptable for specific use by one or more persons. It is also desirable that the quantity of fluid dispensed be controllable to maintain comfort and to avoid over or under saturation during outdoor activities. It is also desirable that the apparatus be low cost and easy to operate.

SUMMARY OF THE INVENTION

The present disclosure generally includes a portable apparatus which delivers a fine spray or fluid, such as gas or liquid. In accordance with various embodiments, an apparatus for delivering a mist of liquid or fluid generally includes a pressurizable fluid tank, a means for pressurizing the fluid tank, such as a compressor, and a fluid conduit in fluid communication with the fluid tank having a plurality of openings therein spaced longitudinally along the conduit for distributing fluid in the form of a corresponding number of fine spray streams.

Various embodiments generally include a portable apparatus which delivers a fine spray or fluid, such as gas or liquid. In accordance with various embodiments, an apparatus for delivering a mist of liquid or fluid generally includes a pressurizable fluid tank, a means for pressurizing the fluid tank, such as a compressor, and a fluid conduit, comprising a hose and/or a wand in fluid communication with the fluid tank having a detachable nozzle for distributing fluid in the form of a corresponding number of fine spray streams.

The flow of fluid through the fluid conduit is controlled by a valve which is located at the inlet to the conduit. The closed distal end of the conduit seals the conduit and forces fluid flowing into the conduit through the openings or nozzles, thereby generating a fine spray or mist. The entire apparatus is compact and economical because, in various embodiments, a flexible fluid conduit enables the mister apparatus to be easily folded for transportation or storage.

Another exemplary embodiment includes a portable apparatus which is configured to pressurize a presented vessel. For instance, the vessel may contain a powder, liquid, gas or other fluid (such as air). In various embodiments, this system may be used to clear a stopped drain. In various embodiments, this system may be used to pressurize and deliver a powder, liquid, gas or other fluid without the use of an introduced gas (other than air), such as aerosol. In various embodiments, this system may be used to quickly switch between more than one fluid tank to deliver at least one of a powder, liquid, gas and/or other fluid (such as air) as needed from a plurality of fluid tanks.

BRIEF DESCRIPTION OF THE DRAWINGS

Exemplary embodiments will hereinafter be described in conjunction with the appended drawing figures, wherein like numerals denote like elements and:

FIG. 1 depicts an exemplary misting apparatus in accordance with various embodiments;

FIG. 2 depicts an exemplary pressurizable fluid tank in accordance with the apparatus of FIG. 1;

FIG. 3 depicts an exemplary fluid conduit in accordance with the apparatus of FIG. 1;

DETAILED DESCRIPTION

Figure 4A:
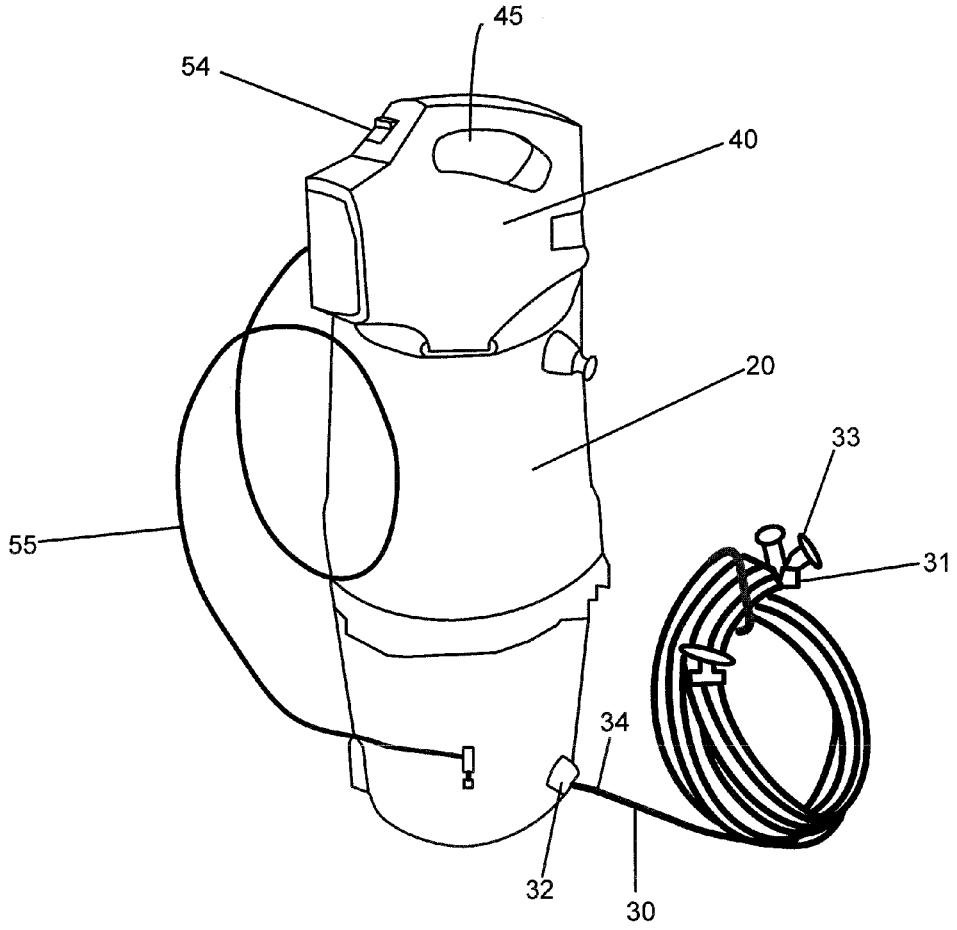
FIGS. 4A and 4B depict a fluid dispersal system and plurality of misting nozzles along a length of fluid conduit.

The detailed description of exemplary embodiments herein makes reference to the accompanying drawings, which show the exemplary embodiments by way of illustration and their best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

With reference to the accompanying Figures, the present invention generally includes a portable apparatus which delivers a fine spray or mist of fluid. In one embodiment, the spray or mist for example the comfortable and efficient outdoor cooling of an area. This may be used to provide comfort via a cooling mist to a human or other animal. In various embodiments, the spray or mister may be configured to be used as a portable bug sprayer, weed sprayer, fogger, pest prevention tool (e.g. ants, scorpions, and spiders), motor degreaser, pheromone sprayer (to attract game), paint sprayer, deck & fence oiling sprayer, body temperature regulator, eye flush, window washer, pressure washer, plant waterer, personal home maintenance tool, defogger, and or the like. For instance, this system may assist with the prevention of disease, (e.g. the spread of malaria and/or west nile virus) by reducing mosquito populations around users. In various embodiments, the apparatus disclosed herein may be configured for pressurizing beer kegs. For instance, using air instead of other gas to pressurize the keg. In various embodiments, the apparatus disclosed herein may be configured for clearing clogged pipes.

Portable misting device 10 may comprise, with particular reference to FIG. 1, a pressurizable fluid tank 20, a fluid conduit 30, an automatic air compressor 40, and a valve 50. In various embodiments, portable misting device 10 may comprise an inline filter for filtering debris from the system. In various embodiments, the inline filter may be located in at least one of the hose line, the outlet of the tank, and between the output of automatic air compressor 40 and the distal end of fluid conduit 30. In various embodiments, portable misting device 10 may comprise a pressure gauge and valve to indicate pressure of a pressurizable fluid tank 20. In various embodiments, portable misting device 10 may comprise a use timer for selecting the duration of portable misting device 10 operation.

In FIG. 2, the pressurizable fluid tank 20 may have at least two openings or one opening which is divisible into two points of entry. A first opening 21 configured to couple with the pressurizing means 40, such as a compact air compressor, and a second opening 22 is configured to couple with the fluid conduit 30. One skilled in the art will appreciate that the openings can be at any suitable location on the fluid tank 20; however, the openings may be located at the top of the fluid tank 20. In various embodiments, fluid tank 20 includes a third opening 23 which allows easy refill of the tank without removing either the pressurizing means 40 or the fluid conduit 30. The first opening 21 and second opening 22 may be threaded to allow quick, air-tight coupling and de-coupling of the pressurizing means 40 and fluid conduit 30, respectively, to fluid tank 20. The third opening 23 may be threaded to accommodate a threaded plug or may be non-threaded and capped; however, all seals may be air-tight when the misting device is in operation. One skilled in the art will appreciate that any suitable coupling can be used to connect the fluid conduit 30 and the pressurizing means 40 to the fluid tank.

To facilitate transport, the fluid tank 20 may include a carrying means, such as a rigid or pliable handle, a strap, a harness, or the like. In one embodiment, a prefabricated fluid tank includes a rigid handle 26 disposed at the top of the tank. In various embodiments, prefabricated fluid tanks that comprise wheels or rollers that increase portability of the misting device are suitable for use in the present invention. In other embodiments, the misting system may be mounted on a vehicle such as a truck, car, bike, golf cart, riding lawnmower, cart or all terrain vehicle. This mounting may be facilitated via housing 70.

Fluid tank 20 may be constructed from a variety of materials, including plastics, polymers, metals and metal alloys. In one embodiment, lightweight, durable materials, such as polytetrafluroethylene (PTFE), are used. Prefabricated fluid tanks which can be adapted for use in the present invention are readily available at a variety of retail outlets.

In various embodiments, fluid tank 20 includes a level indicator means 24, such as a transparent window or external gauge, to indicate to the user when refill of the fluid tank is necessary. Many readily-available prefabricated fluid tanks include transparent windows that serve this purpose or a level indicator can be incorporated into the tank.

The fluid tank 20 may include a cleated or otherwise corrugated base 25 to increase stability and decrease sliding of the misting device 10 when used on inclines or in vehicles, such as boats. Another embodiment of the fluid tank 20 includes a hook or other device for securing fluid conduit 30 to the fluid tank when not in use for convenient storage and transport.

In various embodiments, portable misting device 10 may be docked in a docking station for coupling to a vehicle. In various embodiments, portable misting device 10 may be docked in a docking station for coupling to a power charging apparatus (e.g. to charge a battery). This docking station may be further coupled to a semi-permanent fluid conduit 30. For instance, a fluid conduit 30 run around a predefined area (such as a perimeter). This fluid conduit 30 may have nozzles spaced at pre-determined intervals or at locations of interest for delivering a fluid (or powder, gas, liquid) to the predefined area. For instance, in one embodiment, a user may couple portable misting device 10 to the docking station to enable pest prevention around the perimeter of their property. Various sections of fluid conduit 30 and/or the nozzles of fluid conduit may be disabled as desired. A timer (integral or coupled to the device) may be set to determine times of use, such as, weekly, monthly or daily. In various embodiments, a user may couple portable misting device 10 to the docking station to enable watering to plants.

In FIG. 3, the fluid conduit 30 may comprise a length of tubing 34, either flexible or rigid, having a distal end 31 and a proximal end 32. The proximal end 32 is connected to the fluid tank 20 and the distal end 31 is closed or capped to terminate fluid flow at the distal end of the conduit 30. The fluid conduit 30 may include one or more holes or nozzles 33 spaced along the conduit for distributing fluid in the form of, for example, fine spray streams when fluid from the pressurized fluid tank 20 is forced through the fluid conduit 30. In various embodiments, the fluid conduit 30 comprises a plurality of nozzles 33 suitably spaced longitudinally along a flexible conduit 34 so as to generate a fine mist during operation. In various embodiments, the fluid conduit 30 comprises from about six to about twelve nozzles equally spaced along the conduit.

The fluid conduit 30 may be of any diameter or length suitable to achieve the objectives of the invention. The pressure output of the pressurizing means 40 and the volume of the fluid tank 20 will necessarily limit the diameter and length of the fluid conduit 30, as well as the number of holes or nozzles in the fluid conduit. The fluid conduit and nozzles are readily available at any plumbing supply or hardware store. In various embodiments, at least one MINI-MIST® portable cooling system kit manufactured by Arizona Mist, Inc., part no. 20060-20, is used. Each kit contains UV-resistant ¼ inch flexible tubing, brass and stainless steel mist nozzles, hanging snap clips, a hose adaptor and an end cap. The kit attaches securely to the fluid tank and the nozzles are adjustable to easily change the direction of spray. Multiple kits may be connected in series to provide additional cooling capacity.

The pressurizing means 40 is any suitable device configured to increase pressure inside the fluid tank 20, such as a compact air compressor, a manual air pump, and/or the like. In various embodiments, an automatic, compact air compressor is employed to pressurize the fluid tank 20. The air compressor base may be suitably threaded to attach securely to the first opening 21 in the fluid tank 20 and to form an air-tight seal. In various embodiments, the air compressor comprises a BLACK & DECKER® 7.2 Volt VERSAPAK™ multi-purpose cordless inflator with a modified plastic casing that allows air-tight threaded attachment of the compressor to the first opening 21 of the fluid tank 20. The VERSAPAK™ cordless inflator comprises a rechargeable nickel-cadmium battery pack as described in the Instruction Manual accompanying the device, which is hereby incorporated by reference. The air compressor may be lightweight and durable, as well as inexpensive and easy to maintain.

The pressurizing means 40 may include a power source and a power switch. The power source is any suitable device configured to supply power to the compressor, such as a battery, a rechargeable battery, AC electric power, a solar cell, a fuel-powered generator, and/or the like. In various embodiments, the air compressor 60 includes both a rechargeable battery pack and an AC adapter configured for use with an automobile auxiliary power outlet. In various embodiments, the air compressor 60 includes a remaining power indicator.

The pressurizing means 40 may be automatically controlled such that when the pressure inside the fluid tank 20 reaches a predetermined lower-limit value, such as about 25 psi, the pressurizing means 40 is brought into a load-running state to supply compressed air to the fluid tank 20. When the pressure inside the fluid tank 20 reaches a predetermined upper-limit value, such as about 45 psi, the pressurizing means 40 is brought into a stand-by state to suspend the supply of compressed air to the fluid tank 20. Automatic control of the pressurizing means 40 ensures safe and steady operation of the misting device 10 without the need for substantial user supervision or manual control.

Figure 4B:
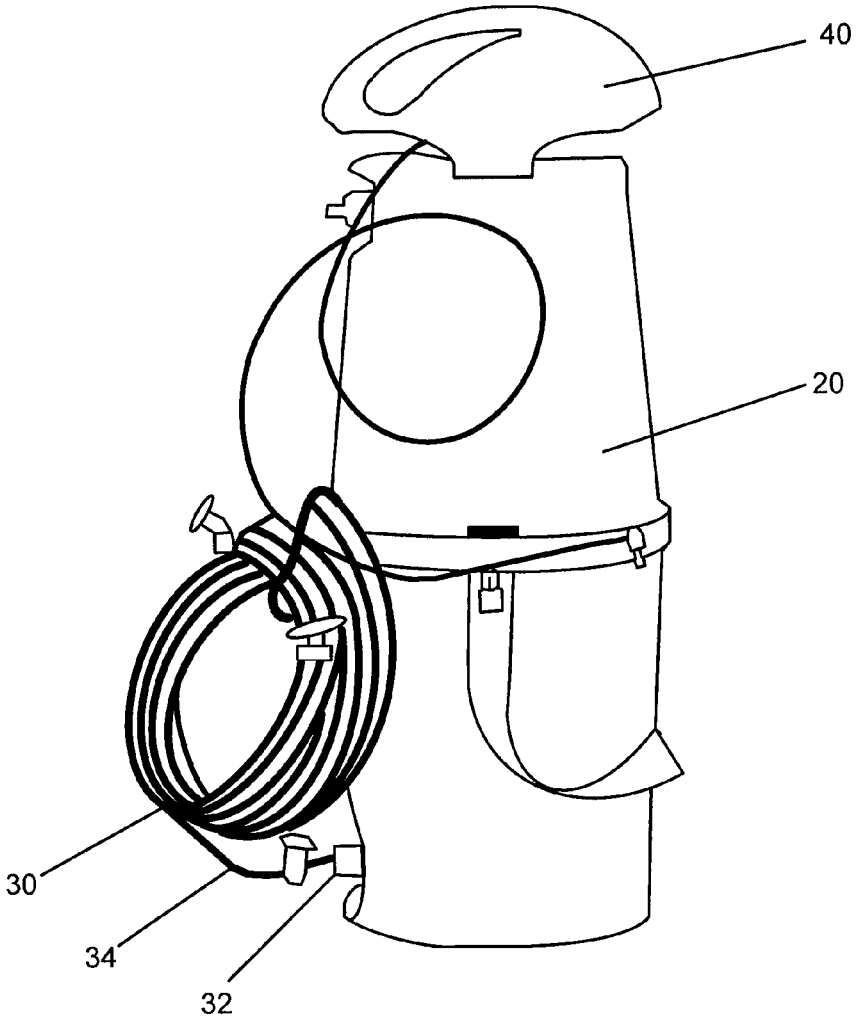

In various embodiments and with reference to FIGS. 4A and 4B, portable misting device 10 may comprise a switch 54 an auxiliary line 55. Switch 54 may be manual or automatic (electrical, pneumatic, etc). By toggling switch 54 between a first position and a second position, the feed of the compressor may be switch from being fed into a pressurizable fluid tank 20 to the auxiliary line 55. The distal end of auxiliary line 55 may comprise a standard adaptor for coupling with standard fittings (such as an adaptor, needle, and the like) for inflating tires, inflatable, tubes, balls, rafts and the like.

Figure 6:
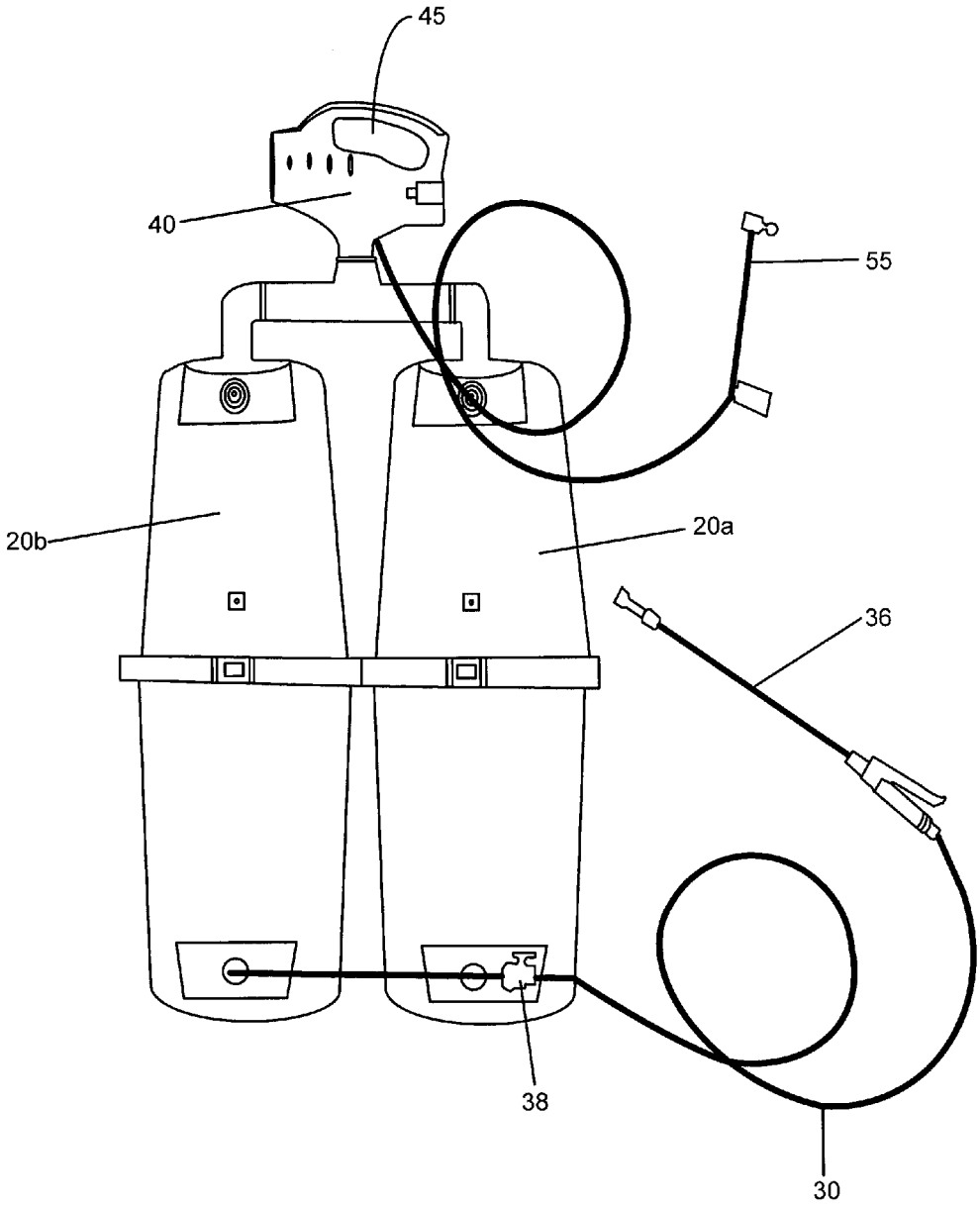
FIG. 6 depicts an exemplary fluid dispersal system comprising a plurality of pressurizable fluid tanks and wand in accordance with various embodiments.

In various embodiments and with reference to FIG. 6, portable misting device 10 may comprise a switch 54 to toggle between a first pressurizable fluid tank and a second pressurizable fluid tank. In some embodiments, switch 54 may be positioned such that a feed of the compressor is allocated between pressurizable fluid tank 20*a* and to pressurizable fluid tank 20*b*. In various embodiments, portable misting device 10 may comprise a switch 38 to toggle between a first pressurizable fluid tank 20*a* and a second pressurizable fluid tank 20*b*. Switch 38 and/or switch 54 may be manual or automatic (electrical, pneumatic, etc). Thus, portable misting device 10 may switch between a weed sprayer to bug repellant sprayer. In various embodiments, portable misting device 10 may switch between a weed sprayer to cooling water mister. In various embodiments, portable misting device 10 may switch between a mister and an air pump for inflating rafts and/or balls. Portable misting device 10 may be toggled between any combination of disclosed uses and any number of pressurizable fluid tanks. In various embodiments, a pressurizable fluid tank (such as one filled with potable water) may comprise an additional line and valves such that a user may drink the water instead of being misted, or in addition to being misted. In various embodiments, a bladder bag (not depicted) may be coupled to the portable misting device 10 comprising potable water with a line to facilitate drinking the water by a user.

Figure 7:
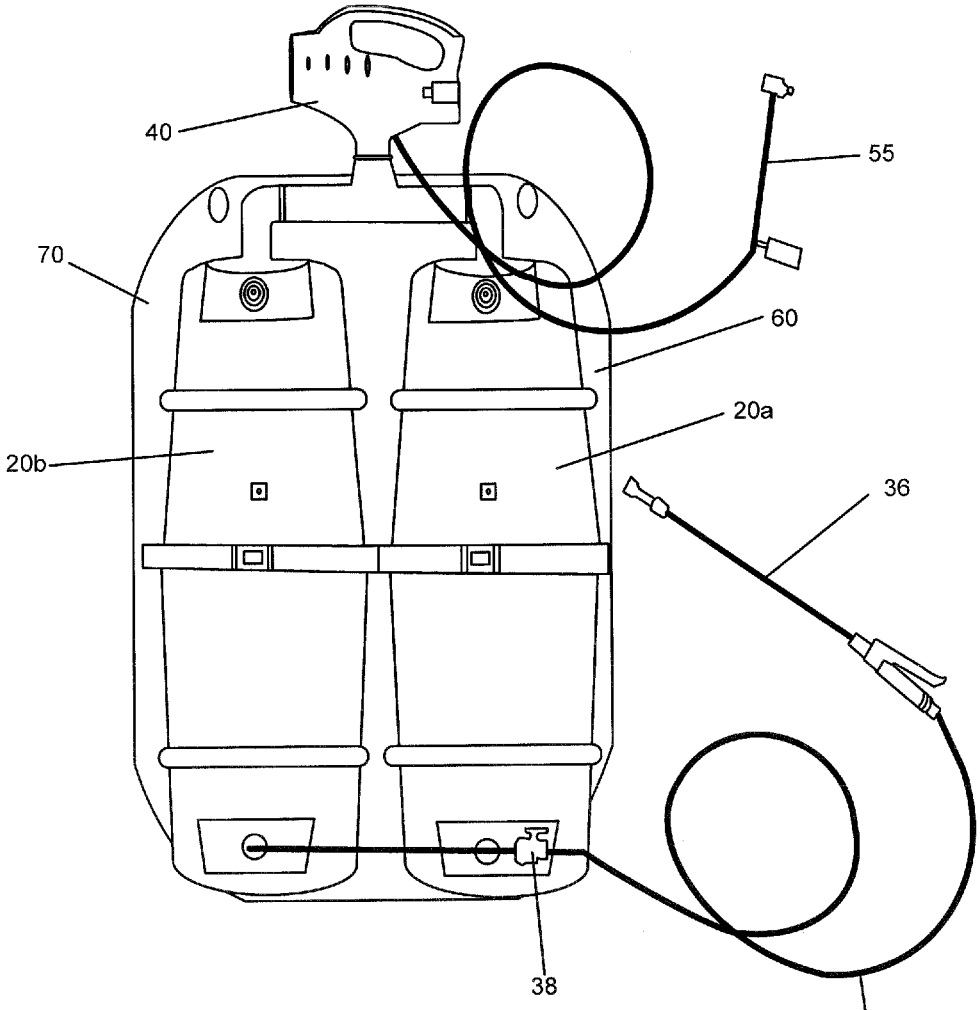
FIG. 7 depicts an exemplary fluid dispersal system comprising a plurality of pressurizable fluid tanks mounted on a housing in accordance with various embodiments.

In various embodiments and with reference to FIG. 7, portable misting device 10 may comprise a mounting device 60 to mount at least a portion of the misting device 10. This may facilitate transport of the misting device on a vehicle, such as a truck, car, bike, golf cart, riding lawnmower, cart or all terrain vehicle.

Figure 8:
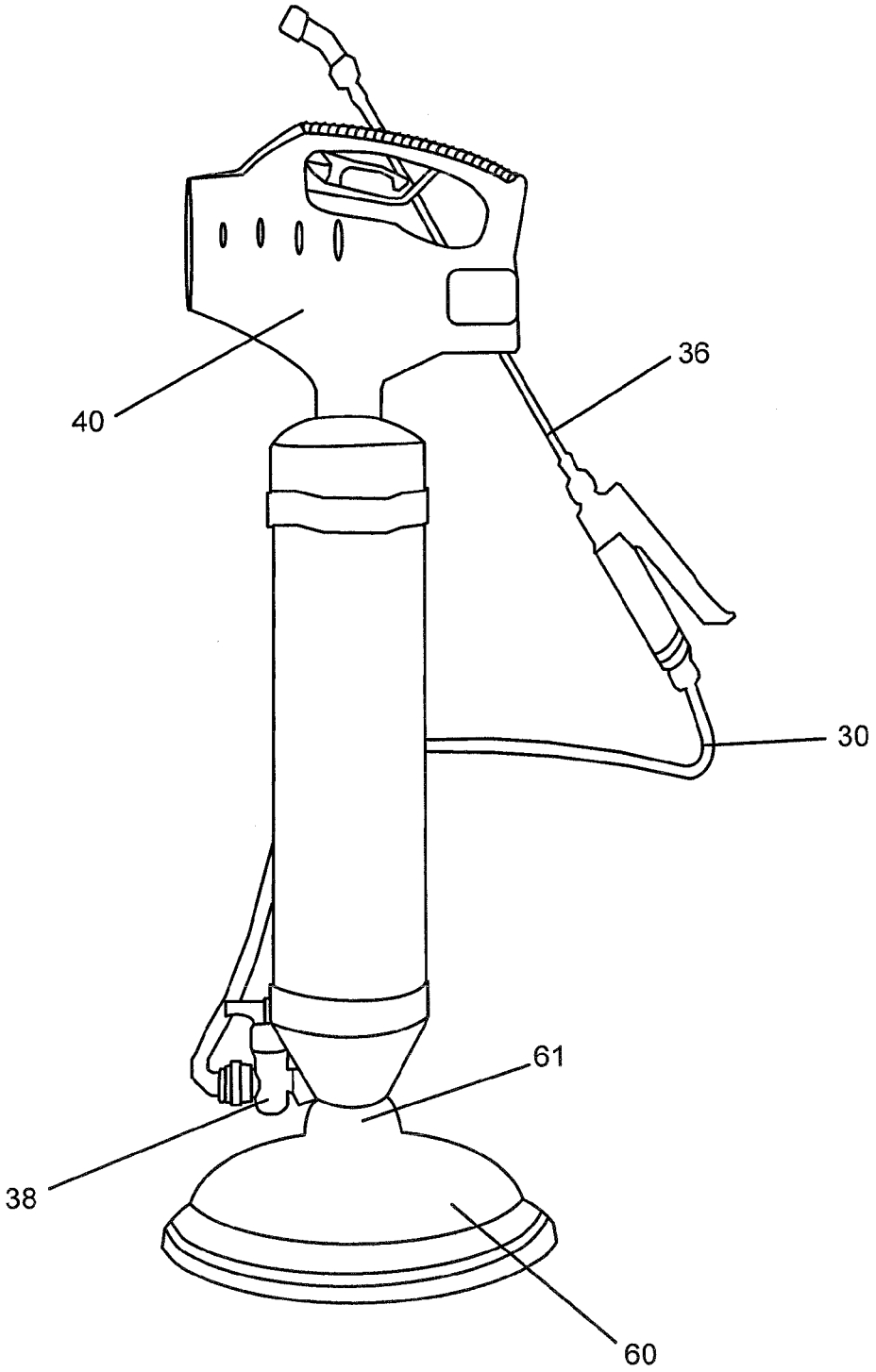
FIG. 8 depicts an exemplary drain clearing and fluid dispersal system comprising an integral pressurizable seal and wand in accordance with various embodiments.

In various embodiments and with reference to FIG. 8, portable misting device 10 may comprise a cup 60 integral to the pressurizable fluid tank for creating at least a partial vacuum between the cup and a drain opening. For instance a clogged drain opening. Cup 60 may comprise a valve 61 between the interior of the cup 60 and pressurizable fluid tank. Pressurizable fluid tank may be filled with fluid, such as water. Cup 60 may come in various sized to accommodate varied drain opening sizes.

In operation, cup 60 may be placed around the opening of a drain. For instance, cup 60 may be placed around a clogged drain opening. A user may position and hold the portable misting device 10 applying force in the direction of the open cup 60 face. The pressure in pressurizable fluid tank may be increased via air compressor 40. Once the pressure within pressurizable fluid tank reaches a predetermined level, a portion of the fluid within pressurizable fluid tank may be released through valve 61 into the void between the cup and the opening of the drain. Valve 61 may be opened via a trigger on the handle of the unit. In response to depressing the trigger, the fluid released through valve 61 may force the clog to open. This may be repeated as needed. This embodiment may reduce the need for harsh chemicals in drain clearing.

In various embodiments and with continued reference to FIG. 8, portable misting device 10 may comprise a switch 38 for toggling between the pressurizable fluid tank and a fluid conduit 30. This may be used for delivering pressurized fluid via a wand 36. For instance, for cleaning areas proximate the clogged drain, such as a vanity, toilet bowl, sink basin, floors, walls. This embodiment may reduce the need for harsh chemicals cleaning surfaces.

In operation, water (or any liquid or gas) may be poured into the fluid tank 20 through the second opening 22 and the pressurizing means 40 is securely attached over the first opening 21. The fluid conduit 30 is securely attached over the second opening 22. If a fluid tank 20 comprising three openings is used, the third opening 23 may be used to fill and re-fill the fluid tank 20, so that the fluid conduit 30 may remain attached over the second opening 22. The pressurizing means 40 is activated at the switch and air fills the remaining space inside the fluid tank 20, thereby increasing the fluid tank pressure. Water from the pressurized fluid tank 20 then enters the inlet of the fluid conduit 30 through a valve 50, flowing until it reaches the closed distal end 31 of the fluid conduit. The water, being restricted from flowing further, is thereby forced through the openings 33 in the fluid conduit 34 to generate a fine mist. The rate of flow of water is controlled by valve 50 and that flow rate determines the volume and range of spray or mist produced. Valve 50 may be of a type which permits a gradual variation of flow between a full flow "ON" position and a no flow "OFF" position.

Other features of the fluid conduit 30 may make the assembly adaptable to a variety of outdoor uses. With reference to FIGS. 4A and 4B, a plurality of small hooks, clips, or hook-loop (Velcro®) fasteners may be spaced at intervals along the length of the fluid conduit 30 to enable the conduit to be securely mounted to a structure such as a tent, a chair, a canopy, a watercraft railing, or a tree. In addition, a quick-coupling assembly may be employed between the fluid conduit 30 and the fluid tank 20 to further facilitate assembly and disassembly of the misting device 10 for convenient storage and transport. For example, a ½ inch "cam & groove" coupling of the type commercially provided for connecting fire hoses may be utilized with the fluid conduit 30 employed in various embodiments.

It has been found that a variety of commercially available nozzles are suitable for producing the very fine mist desired by various embodiments. Furthermore, it has been found that a flow rate of 0.5 gallons per hour through each nozzle is suitable for producing this fine mist. Although these features are desirable, it should be understood that any flow rate, pipe diameter, and nozzle combination which produces a suitable fine water mist could be utilized in accordance with the present invention.

In one embodiment, pressurizing means 40 comprises a lithium battery operated air compressor. The air compressor may compresses air into a container filled with fluid and push the fluid thru an outlet line. The outlet line may comprise a wand 36 or multi-tip line used for spraying a fluid (of any suitable type or viscosity). For instance, wand 36 may further comprise a trigger for dispensing fluid. The spray tips may range from substantially the size of a pin hole to substantially the size of a fire hose.

In one embodiment, a previous aerosol based application, such as spray paint, hair spray, deodorizer, liquid cleaning supply can be delivered via the present method and apparatus without the need for aerosol. Stated another way, aerosol is a suspension of fine solid particles or liquid droplets in a gas. Using the pressurizing means 40 and system any fluid can be safely dispersed through the system.

Figure 5C:
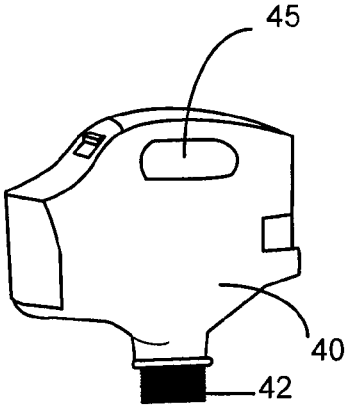
FIGS. 5A-5C depict a hand held pressurizing device configured to be able to be coupled to a pressurizable fluid tank.
Figure 5B:
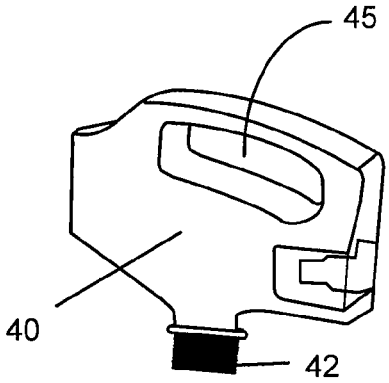
Figure 5A:
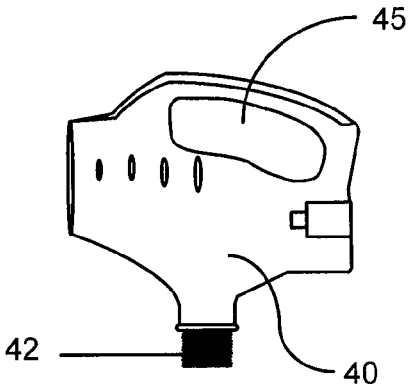

The unit may be configured to comprise a canister with a spray apparatus, such as a spray gun and a portable handheld mini air compressor. The mini air compressor may be located anywhere within the device. With reference to FIGS. 5A-5C, the mini air compressor 40 is located within the handle 45 of the system. The compressor 40 may be coupled to a pressurizable fluid tank 20 or to a conduit coupled to at least one pressurizable fluid tank 20 via a coupling means. This may include, tabs, pin, threading, pressure fit, and/or other suitable coupling means.

Fluid may be introduced to the canister through an opening, such as a lid. These may be any fluids such as paint, hair spray, liquid cleaning supplies, etc. Next, the compressor is activated. The compressor may be activated by triggering a switch, level, button, dial, electronic readout, and/or electronic interface, which will pressurize the canister to a desired pressure. Dispersal of the liquid may be facilitated by triggering a switch, level, button, dial, electronic readout, and/or electronic interface. For instance pulling the spray trigger a selectable choice of liquid will be spraying out. For instance, more than one fluid may be stored in various multiple fluid tanks 20. In various embodiments the system may utilize larger tanks, such as greater than 10 gallons. The highly portable device customized for a specific use may be used indoors or outside. For instance, used at outside events which get infested by mosquitoes and gnats. The system may be utilized as a fogger for outside insects and pests. In various embodiments, the system may be used for therapeutically misting inside or outside for extreme relief and relaxation.

Principles of the present disclosure may also suitably be combined with principles of misters as disclosed in a U.S. Pat. No. 6,189,805, entitled "AUTOMATIC PORTABLE MISTING DEVICE" filed on Sep. 24, 1998 and having common ownership as the present application, the contents of which are hereby incorporated by reference in their entirety.

The apparatus may be constructed of a variety of different materials. However, the materials are suitably selected to account for the stresses to which the apparatus will be subjected during operation, such as water, heat, rugged transport, and direct sunlight.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the invention. The scope of the invention is accordingly to be limited by nothing other than the appended claims, in which reference to an element in the singular is not intended to mean "one and only one" unless explicitly so stated, but rather "one or more." Moreover, where a phrase similar to 'at least one of A, B, and C' or 'at least one of A, B, or C' is used in the claims or specification, it is intended that the phrase be interpreted to mean that A alone may be present in various embodiments, B alone may be present in various embodiments, C alone may be present in various embodiments, or that any combination of the elements A, B and C may be present in a single embodiment; for example, A and B, A and C, B and C, or A and B and C. Although the invention has been described as a method, it is contemplated that it may be embodied as computer program instructions on a tangible computer-readable carrier, such as a magnetic or optical memory or a magnetic or optical disk. All structural, chemical, and functional equivalents to the elements of the above-described exemplary embodiments that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A misting apparatus comprising:

a portable, pressurizable first fluid tank;

a pressurizing device removably coupled to the first fluid tank, wherein the pressurizing device is configured to provide air pressure inside the first fluid tank;

a power source in communication with the pressurizing device, wherein the power source includes a power adaptor configured for use with an auxiliary power outlet;

a misting conduit having a plurality of holes, wherein the misting conduit is in fluid communication with the first fluid tank, and wherein the misting conduit is configured to disperse a mist over an area, in response to the air pressure inside the first fluid tank;

an auxiliary air conduit in communication with the pressurizing device, wherein the auxiliary air conduit comprises at least one of a hose or a dispersal wand, and wherein the auxiliary air conduit is configured to be mated with a vessel, and wherein the auxiliary air conduit is configured to supply the air pressure to an inside of the vessel; and a switch configured to send different portions of the air pressure from the pressurizing device such that the first fluid tank has the first air pressure and a second fluid tank has a third air pressure, while the misting conduit remains in fluid communication with the first fluid tank and while the auxiliary air conduit remains in communication with the pressurizing device.

2. The misting apparatus of claim 1, wherein the power source is at least one of battery, a rechargeable battery, AC electric power, a solar cell, or a fuel-burning generator.

3. The misting apparatus of claim 1, wherein the switch is at least one of manual or electronic.

4. The misting apparatus of claim 1, further comprising a filter inline with the misting conduit.

5. The misting apparatus of claim 1, further comprising a filter inline with the hose.

6. The misting apparatus of claim 1, further comprising a coupling mechanism configured to be received by a docking station, wherein the docking station is configured to securably couple the misting apparatus to a vehicle.

7. The misting apparatus of claim 1, further comprising a coupling mechanism configured to be received by a docking station, wherein the docking station is configured to at least one of charge a power source of the misting apparatus or time operation of the misting apparatus.

8. The misting apparatus of claim 1 further comprising a valve coupled between the first fluid tank and the misting conduit for controlling flow of fluid through the conduit.

9. The misting apparatus of claim 1, wherein the vessel includes at least one of a tire, inflatable, tube, ball, or raft.

10. The misting apparatus of claim 9, wherein the output of the compressor is from about 25 to about 45 psi.

11. The misting apparatus of claim 1, further comprising an adapter configured to mate with the air conduit, wherein the adapter facilitates opening a portion of the vessel to allow the air pressure to enter inside the vessel.

12. The misting apparatus of claim 11, further comprising a carrying means selected from the group consisting of a handle, a strap, and a harness.

13. The misting apparatus of claim 1, wherein the first fluid tank further includes at least one of a fluid level indicator or a duration of use timer.

14. The misting apparatus of claim 1, further comprising a quick coupling connector between the first fluid tank and the misting conduit.

15. A drain attachment device comprising:

a portable, pressurizable first fluid tank;

a pressurizing device removably coupled to the first fluid tank, wherein the pressurizing device is configured to provide air pressure inside the first fluid tank;

a power source in communication with the pressurizing device;

a cup configured to create a seal over a clogged drain opening, wherein the cup is integral to the first fluid tank, wherein in response to the air pressure within the pressurizable first fluid tank reaches a predetermined level, a portion of the fluid within the pressurizable fluid tank is released through a valve into a void between the cup and the clogged drain opening;

the auxiliary air conduit in communication with the pressurizing device, wherein the air conduit comprises at least one of a hose or a dispersal wand, and wherein the air conduit is configured to be mated with a vessel, and wherein the air conduit is configured to supply the air pressure to an inside of the vessel; and a switch configured to divert the air pressure from the pressurizing device, from the first fluid tank to the auxiliary air conduit, while the cup remains over the clogged drain opening and while the auxiliary air conduit remains in communication with the pressurizing device.

16. The drain attachment device of claim 15, wherein the air pressure inside the first fluid tank is increased such that a fluid within the first fluid tank may be released through a valve between the first fluid tank and the cup into the clogged drain opening to unclog the drain.

17. The drain attachment device of claim 15, wherein the switch is further configured to send different portions of the air pressure from the pressurizing device such that the first fluid tank has the first air pressure and a second fluid tank has a third air pressure.

18. A method of fluid dispersal comprising:

providing, via activation of a power source on a pressurizing device, air pressure inside of a portable, pressurizable first fluid tank, wherein the pressurizing device is removably coupled to the first fluid tank, wherein the pressurizing device is configured to provide air pressure inside the first fluid tank, wherein the power source is in communication with the pressurizing device, and wherein the power source includes a power adaptor configured for use with an auxiliary power outlet;

forcing, in response to providing the air pressure, a fluid inside a misting conduit having a plurality of holes, wherein the misting conduit is in fluid communication with the first fluid tank, and wherein the misting conduit is configured to disperse a mist over an area, in response to the air pressure inside the first fluid tank;

dispersing the mist over the area;

adjusting a switch, wherein the switch is configured to send different portions of the air pressure from the pressurizing device such that the first fluid tank has the first air pressure and a second fluid tank has a third air pressure;

diverting the air pressure from the first fluid tank to the auxiliary air conduit, while the misting conduit remains in fluid communication with the first fluid tank and while the auxiliary air conduit remains in communication with the pressurizing device, wherein the air conduit is in communication with the pressurizing device, and wherein the auxiliary air conduit comprises at least one of a hose or a dispersal wand; and transferring the air pressure from the auxiliary air conduit to an inside of a vessel.

19. The method of claim 18, wherein the vessel includes at least one of a tire, inflatable, tube, ball, or raft.

* * * * *